United States Patent [19]

Warland

[11] Patent Number: 4,919,174

[45] Date of Patent: Apr. 24, 1990

[54] FILLING MEANS

[76] Inventor: John R. Warland, 5 William St., Hamilton, N.S.W., 2303, Australia

[21] Appl. No.: 37,188

[22] Filed: Apr. 10, 1987

[30] Foreign Application Priority Data

Apr. 11, 1986 [AU] Australia ..... PH05426

[51] Int. Cl.[5] ..... B65B 1/30

[52] U.S. Cl. ..... 141/384; 141/226; 141/348; 141/387; 141/198

[58] Field of Search ..... 141/226, 348–350, 141/382–389, 198; 137/461, 495

[56] References Cited

U.S. PATENT DOCUMENTS

| | | | |
|---|---|---|---|
| 2,363,123 | 11/1944 | Franck | 141/209 |
| 2,633,866 | 4/1953 | Reasuner | 141/226 X |
| 2,680,030 | 6/1954 | Hoelzer | 141/384 X |
| 2,703,096 | 3/1955 | Overbeke et al. | 141/226 X |
| 3,055,405 | 9/1962 | Pase | 141/384 X |
| 3,086,565 | 4/1963 | Mosher | 141/384 X |
| 3,208,486 | 9/1965 | Fromm | 141/385 X |
| 3,252,721 | 5/1966 | Weasler | 285/316 X |
| 3,662,793 | 5/1972 | Calisher et al. | 141/198 |
| 3,674,061 | 7/1972 | Calisher et al. | 141/226 X |
| 4,314,582 | 2/1982 | Drori | 137/495 |
| 4,501,290 | 2/1985 | Sturman et al. | 137/495 |
| 4,503,883 | 3/1985 | Meachom, Jr. | 137/461 X |

*Primary Examiner*—Ernest G. Cusick

*Attorney, Agent, or Firm*—Anthony A. O'Brien

[57] ABSTRACT

An automatic shut-off nozzle for a vehicle servicing system can be rapidly mated to a receiver fitting on a fuel tank. Both the nozzle and the receiver have valves which are normally closed but which open when the nozzle is mated to the receiver. The nozzle includes a piston which moves so as to displace a spring-biased operculum forming the valve of the receiver; the piston is automatically retracted when the receiver is filled.

1 Claim, 2 Drawing Sheets

FILLING MEANS

TECHNICAL FIELD

This invention relates to filling means or liquid transfer apparatus, and more particularly to a pressure sensitive, automatic shut-off nozzle for a vehicle servicing system.

BACKGROUND ART

Conventional apparatus for filling motor vehicle fuel tanks invariably include a hand-held "pistol type" nozzle incorporating a trigger and some kind of automatic cut-off device which is actuated to stop the flow of liquid when the liquid level in the tank reaches the delivery conduit of the nozzle. Since the conduit is not connected to the inlet port of the tank in any way, but is merely thrust loosely into it, the danger of contamination is considerable. Moreover, such a system—known as "splash-filling"—is generally limited to a flow-rate of perhaps 135 liters per minute. Thus, "splash-fillings" are appropriate only for such applications as roadside gas stations and the like, and are totally unsuited to situations in which heavy construction and mining equipment —for instance Unimogs—must be continually serviced as rapidly as possible.

It has been proposed to provide refuelling apparatus including a receiver mountable in a sidewall of a tank or container, close to the bottom, and a refuelling nozzle adapted to be received in the receiver. Such apparatus is disclosed, for example, in specifications relating to U.S. Pats. No's 3,662,793 and 3,674,061. In these and related apparatus', both the receiver and the nozzle have normally closed valves which open in response to the mating of the two parts. The nozzle is equipped with such a normally—closed "snap-acting" valve which is cocked open during the filling operation but snaps closed in response to rise in back-pressure. During the filling operation a tank vent is open but closes in response to the rise in the liquid level which thus creates the back-pressure.

The previously know apparatus had a veritable plethora of component parts requiring continuing maintenance, the piston rod was spring-biased but performed unsatisfactorily. In later developments the spring was replaced by a flexible and resilient diaphragm but this proved to be even more unsatisfactory inasmuch that foreign matter entrained in the fuel was found to tend to seriously affect diaphragm cut-off with possible subsequent rupture of the diaphragm itself.

In practice it was found that even pressures of no more than 70 p.s.i. could cause rupture of the diaphragm, thus diaphragm replacement is a major maintenance problem. In fact, pressures in excess of 90 p.s.i. are not uncommon.

It was also found that the barrel—as that referenced 137 in FIG. 3 of U.S. Pat. No. 3,674,061—was very prone to crack during heavy engagement operation. Moreover, the stayback-rod is prone to wear and breakage.

SUMMARY OF THE INVENTION

It is therefore an object of the present invention to overcome the above and other disadvantages by the provision of an automatic shut-off nozzle for a vehicle servicing system, which nozzle may comprise a housing defining a liquid delivery passageway commmunicatable with a liquid delivery hose and a spring-accommodating chamber; a piston reciprocally movable within said housing; a spring affixed to and surrounding the piston and accommodated within said chamber; a longitudinal passageway through the piston, communicating the liquid delivery passageway with the spring-accommodating chamber; and an enlarged portion on the forward end of the piston, this enlarged portion being adapted to displace a spring-biased operculum of a co-acting receiver when the piston is in an operative position.

Preferably, the enlarged portion may be accommodated within a muzzle portion of the nozzle, this muzzle portion, at its free end, having set thereabout a peripheral array of radially-spaced ball-bearings constituting a ball-race; and an axially movable, spring-urged collet surrounding the free end and shrouding the ball-race; the collet, when moved away from the free end, permitting the bearings to ride over an annular bead provided on an outer wall of the co-acting receiver, the collet also, when it is moved towards the free end, causing the bearings to engage an annular groove provided on the said outer wall to thereby mate the muzzle with the co-acting receiver.

The piston may have a cocking handle on its end remote from the enlarged portion, this cocking handle being manually operable to move the piston longitudinally within the nozzle housing, so as to displace the operculum after the bearings of the ball-race have been engaged with the annular groove.

The spring may act to move the piston longitudinally within the housing so as to allow the operculum to close off the receiver in response to back-pressure transmitted to the spring-accommodating chamber via the longitudinal passageway through the piston.

BRIEF DESCRIPTION OF THE DRAWINGS

In order that the reader may gain a better understanding of the present invention, hereinafter is described a preferred embodiment thereof, by way of example only, and with reference to the accompanying drawings, in which.

DETAILED DESCRIPTION OF THE PREFERRED EMBODIMENT

Figure 1:
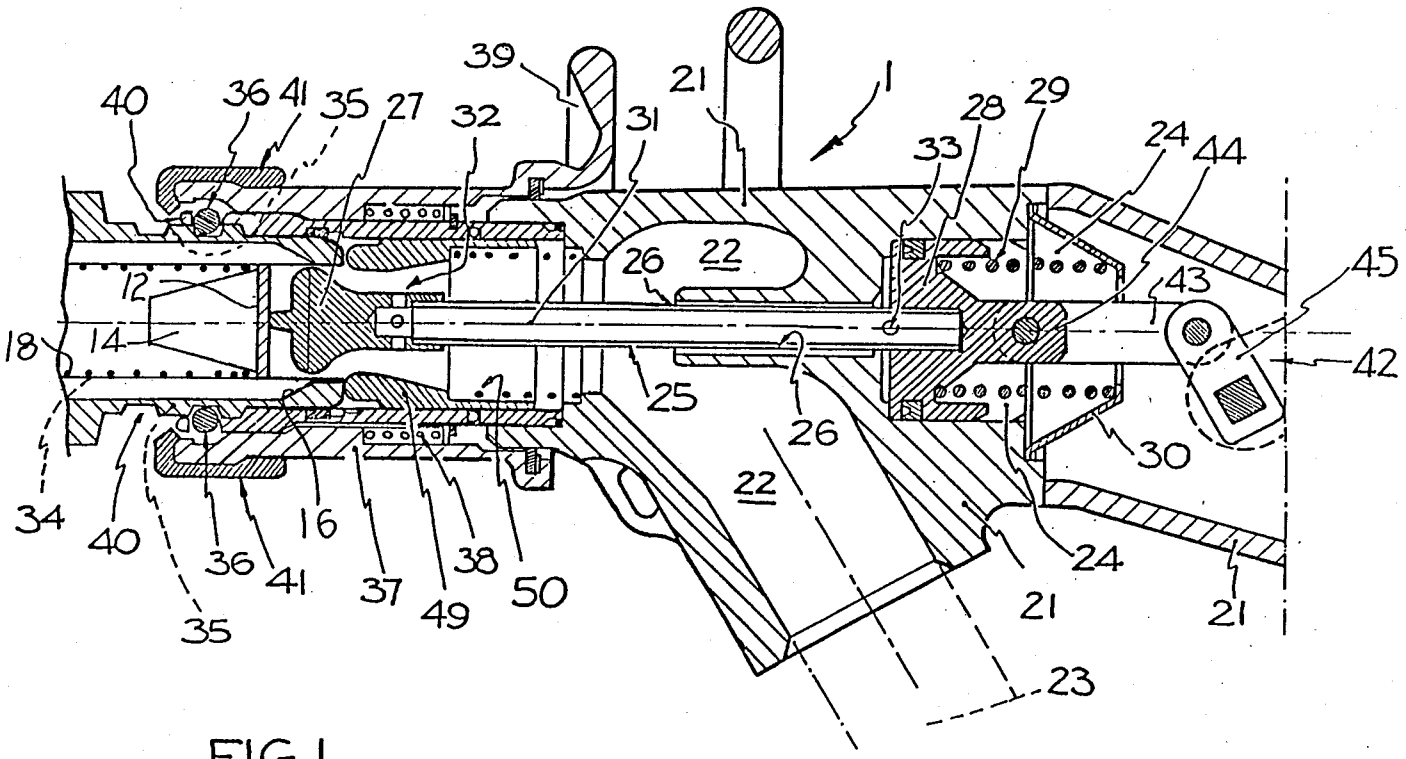
FIG. 1 is a part vertical section through an automatic shut-off nozzle according to the present invention; while FIG. 2 will clearly be seen to be a continuation drawing of FIG. 1.
Figure 2:
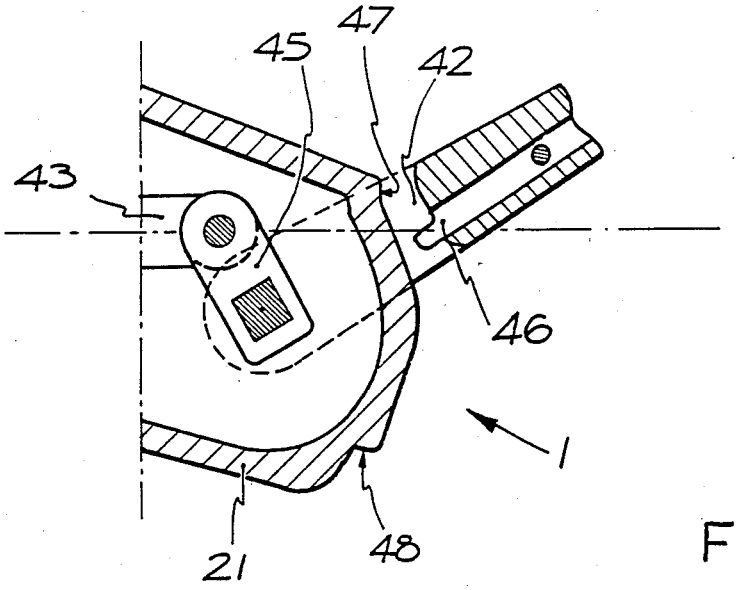

The inventive refuelling automatic shut-off nozzle, generally referenced 1, includes a cast metal housing 21 which defines a liquid delivery passageway 22 which communicates with a conventional flexible fuel delivery hose as indicated at 23 and with a spring-accommodating chamber 24. Reciprocally movable within the housing 21 is a piston 25 which slides in a phosphor-bronze or stainless steel bush 26 and which has an enlarged portion 27 at its forward or muzzle end. Affixed to and surrounding a "big end" 28 of piston 25 is a helical spring 29, accommodated, as shown, in the spring-accommodating chamber 24. That end of helical spring 29 which is remote from enlarged end 27 is held by such as a "spider" 30.

Through piston 25 there extends a longitudinal conduit or passageway 31 which communicates the liquid delivery passageway 22 with the spring-accommodating chamber 24 via ports 32 and 33.

Mountable in a sidewall of a tank or other container, close to the bottom, is a receiver, shown in broken line and generally referenced 34. The receiver consists essentially in a hollow cylindrical housing, its outer end being able to be closed by a loose disc—aptly known in the trade as an operculum 12 mounted on a valve body 14 in normally urged into the closed position against a valve seat 16 adjacent the outer end of the receiver 34 to seal the tank, by means of a helical compression spring 18. The receiver may be affixed into a cylindrical recess in the sidewall of the tank or it may project from the said sidewall. The housing of the receiver is provided with an annular bead 35, the purpose of which will be made clear hereinafter.

The forward end or muzzle of the nozzle 1 has set therein a plurality of ball-bearings 36, perhaps 8 in number and arranged as a ball-race. Surrounding the muzzle is an axially movable collet 37 which is spring-urged by the helical spring 38 and shrouds the ball-race, but which can be pulled rearwardly by a handle 39 to permit the ball-bearings 36 to ride over annular bead 35. Thus, it will be realized that nozzle and receiver may be mated by causing balls 36 to engage annular groove 40, disengagement being brought about by pulling collet 37 rearwardly to allow ball-bearings 36 to ride up and over annular bead 35 so as to release the nozzle from the receiver. The engaging end of collet 37 may be fitted with a resilient rubber or plastic buffer member 41.

The mode of operating the servicing system nozzle of the present invention is generally as follows:- the nozzle is engaged in the receiver as described above. What may be termed a "cocking handle" 42 is attached to piston 25 via a link 43 pivoted at one end to a lug 44 of the "big end" of the piston and at the other to a bell-crank or toggle 45. Movement of cocking handle 42 is limited by virtue of a spring-loaded locking pin 46 adapted to engage with either one of the two detents 47 and 48.

In the "on" or fueling position shown in FIG. 1, with the cocking handle in the upwardly directed position, piston 25 is caused to move longitudinally towards the muzzle so that the operculum of the receiver is pushed inwardly by piston head or enlarged portion 27 to enable liquid to flow through the receiver and on into the tank; pumping can be commenced at this point.

When the level of liquid fuel in the tank has reached a certain point, a conventional float-valved vent closes to seal off the tank. Fluid continues to flow into the tank but since displaced air can no longer escape, pressure builds up in the tank. At a preset pressure, the pressure engendered by this back-flow through piston passageway or conduit 31 actuates "big end" 28, against the biasing force of helical compression spring 29, to move it rearwardly together with attached piston 25 to such an extent that withdrawal of enlarged piston head portion 27 allows the operculum of the receiver 34 to close off the receiver and so seal the tank. Concommitant movement of toggle 45 brings the handle 42 back to lock into its down or "off" position and the pump stops automatically, with enlarged portion moving back within the housing until it seats sealingly upon the forwardly directed rim of a collar or piston 49 against the biasing force of a helical spring 50. Pulling back on collet handle 39 disconnects the nozzle from the receiver, and the next vehicle in line can be similarly serviced with a minimum of delay.

The present invention is superior to the prior art automatic shut-off nozzles in that the piston—fabricated from stainless steel tube—is affixed to the "big end" and in that pressure limitation is only by virtue of the strength of the spring acting on the piston. The spring-loaded dogs of the prior art nozzle muzzles were a particularly weak point and, with the associated stay-back rod, had a very short working life.

Automatic shut-off nozzles according to the present invention have fewer components and are easier to maintain and service. Operating pressures as high as 330 p.s.i. are possible with the present invention.

INDUSTRIAL APPLICABILITY

Although the invention has particular application in the field of refuelling heavy construction and mining equipment, it will be realised that it may equally well be employed to fill with liquids containers in general; for example, in crankcase and transmission oil filling operations, hydraulic fluid tank filling and coolant tank filling.

From the abovegoing, it will be readily appreciated by those skilled in the art that numerous variations and modifications may be made to the invention without departing from the spirit and scope thereof as set out in the following claims.

I claim:

1. In a vehicle servicing system having a liquid receiver (34) adapted to be mounted in the sidewall of a tank and including a hollow cylindrical portion having an outer end and an outer wall, an annular bead (35) on the outer wall, an annular groove (40) on said outer wall adjacent the annular bead (35), valve means (16) for closing the outer end, and a spring biased operculum (12) adapted to normally close the valve means (16), in combination with a nozzle;

the combination being characterized in that the nozzle comprises:

a housing (21) having a separate chamber (24) and a liquid delivery chamber (22) adapted to communicate with a hose (23) for delivery of liquid;

a muzzle portion on said housing (21) including a free end, a peripheral array of ball bearings (36) on said free end, an axially movable spring-biased collet (37) surrounding said free end and shrouding said array of ball bearings (36), said collet (37) being movable away from said free end whereby said array of ball bearings (36) are adapted to ride over said annular bead (35) on said outer wall of the receiver (34) to unlock said muzzle portion from the receiver (34), said collet (37) being movable toward said free end whereby said array of ball bearings (36) are adapted to engage said annular groove (40) on said outer wall of the receiver (34) to lock said muzzle portion to the receiver (34);

a piston assembly movable within said housing (21) including a piston rod (25) having opposite end portions, a piston head (27) on one end portion in said muzzle portion, and a large portion (28) fixed on the other end portion in said separate chamber (24) and having a sealed piston surface adapted to be pressure responsive for moving said large portion (28) in one direction, a compression spring (29) in said separate chamber (24) biasing said large portion (28) in a direction opposite said one direction along with said piston rod (25) and the piston head (27) causing displacement of the operculum (12) to an opened position, a longitudinal passageway (31) extending through said piston rod (25) between the opposite ends thereof, a first port means (32) in the one end portion of said piston rod (25) adjacent the piston head (27) to communicate with said longitudinal passageway (31), a second port means (33) in the other end portion of said piston rod (25) to communicate with said longitudinal passageway (31), said first port means (32) communicating with the delivery chamber (22) and said second port means (33) communicating with a portion of said separate chamber (24) sealed by the large portion (28) whereby back pressure in the muzzle portion when liquid fills the tank acts on the piston surface of large portion (28) causing displacement of the piston head (27) whereby the spring biased operculum (12) moves to a closed position; and, a cocking handle (42) operatively connected to said large portion (28) on said piston rod (25) and being manually operable to move said piston rod (25) longitudinally in said housing (21) and thereby displace the operculum (12) to an opened piston after said array of ball bearings (36) engage the annular groove (40).

* * * * *